US008960832B2

(12) United States Patent
Kamibayashi et al.

(10) Patent No.: US 8,960,832 B2
(45) Date of Patent: Feb. 24, 2015

(54) LIQUID EJECTING APPARATUS AND CONTROLLING METHOD THEREOF

(71) Applicant: Seiko Epson Corporation, Tokyo (JP)

(72) Inventors: Masashi Kamibayashi, Matsumoto (JP); Tomohiro Sayama, Matsumoto (JP); Yoshihiro Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/108,206

(22) Filed: Dec. 16, 2013

(65) Prior Publication Data

US 2014/0168299 A1 Jun. 19, 2014

(30) Foreign Application Priority Data

Dec. 17, 2012 (JP) ..... 2012-274311
May 29, 2013 (JP) ..... 2013-112572

(51) Int. Cl.
*B41J 29/38* (2006.01)
*B41J 2/165* (2006.01)
*B41J 2/045* (2006.01)

(52) U.S. Cl.
CPC ..... *B41J 2/04588* (2013.01); *B41J 2/04551* (2013.01); *B41J 2/04556* (2013.01); *B41J 2/04581* (2013.01); *B41J 2/04596* (2013.01)
USPC ..... 347/10; 347/9; 347/11; 347/27

(58) Field of Classification Search
CPC ..... B41J 2/04581; B41J 2/04588; B41J 2/04593; B41J 2/04596
USPC ..... 347/9, 10, 11, 27
See application file for complete search history.

(56) References Cited

U.S. PATENT DOCUMENTS

| | | | | |
|---|---|---|---|---|
| 6,827,414 | B2 | 12/2004 | Iwatsuki et al. | |
| 6,908,167 | B2 | 6/2005 | Kitami et al. | |
| 8,042,896 | B2 | 10/2011 | Nishimura | |
| 2002/0012017 | A1 * | 1/2002 | Yonekubo | 347/10 |
| 2013/0050328 | A1 | 2/2013 | Yanagishita | |

FOREIGN PATENT DOCUMENTS

| | | | |
|---|---|---|---|
| JP | 4-064136 | U | 6/1992 |
| JP | 2002-096484 | A | 4/2002 |
| JP | 2002-351322 | A | 12/2002 |
| JP | 2003-311938 | A | 11/2003 |
| JP | 2004-122760 | A | 4/2004 |
| JP | 2009-279816 | A | 12/2009 |
| JP | 2013-047398 | A | 3/2013 |

* cited by examiner

*Primary Examiner* — Jannelle M Lebron
(74) *Attorney, Agent, or Firm* — Kilpatrick Townsend & Stockton LLP

(57) ABSTRACT

A minute vibration driving signal is configured to include a first signal section which generates a plurality of minute vibration driving pulses, and a second signal section which maintains potential to a constant level without generating the minute vibration driving pulse, and can select a first mode in which duration of the second signal section is set to T2 which is longer than duration T1 of the first signal section, and a second mode in which duration of the second signal section is set to T4 which is longer than T2.

7 Claims, 11 Drawing Sheets

LIQUID EJECTING APPARATUS AND CONTROLLING METHOD THEREOF

BACKGROUND

1. Technical Field

The present invention relates to a liquid ejecting apparatus such as an ink jet type printer, and a controlling method thereof, particularly to a liquid ejecting apparatus which ejects liquid including a component, sedimentation of which sometimes occurs, and a controlling method thereof.

2. Related Art

For example, a liquid ejecting apparatus is an apparatus which includes a liquid ejecting head capable of ejecting liquid from nozzles and which ejects various types of liquid from this liquid ejecting head. As a representative apparatus of this liquid ejecting apparatus, there is provided an image recording apparatus such as an ink jet type printer (hereinafter, simply referred to as a printer) which includes an ink jet type recording head (hereinafter, simply referred to as a recording head) as the liquid ejecting head, and performs recording of an image or text by ejecting and landing liquid-type ink with respect to a recording medium (landing target) such as a recording sheet, from nozzles of the recording head.

In recent printers, there is an apparatus which is configured so as to correspond to various uses, using special ink other than general color ink including color materials of black (K), cyan (C), magenta (M), and yellow (Y) which are basic colors for forming text or an image. For example, a printer disclosed in JP-A-2002-351322 is configured to perform recording using white ink including a white pigment such as titanium oxide or silver ink including a metal pigment having gloss such as aluminum foil. The specific gravity of the color material of the white ink or the silver ink is greater than the specific gravity of the color material of the general color ink. Accordingly, in the white ink or the silver ink, the color material tends to be readily sedimented with a lapse of time. In addition, there are differences in degrees, but sedimentation of the pigments also occurs in general pigment ink. If the sedimentation of the color material (pigment) progresses, there is a concern that the ink will not be normally ejected due to clogging of nozzles. For suppressing such malfunction, in this type of printer, by applying a minute vibration pulse to a pressure generation unit (for example, a piezoelectric vibrator or a heater element) and driving the pressure generation unit in a period when the ink is not ejected, the ink in a pressure chamber and meniscus are minutely vibrated to a degree of not ejecting the ink from the nozzles. That is, the ink in the pressure chamber and the ink adjacent to the nozzles are agitated by this minute vibration.

As described above, in the printer employing the ink containing a component, sedimentation of which relatively readily occurs, it is desirable to suppress the sedimentation by executing the minute vibration operation as much as possible. However, if the minute vibration operation is continued, there is a problem that the ink is thickened. That is, since the meniscus of nozzles is exposed to the atmosphere, the ink adjacent to the nozzles is readily thickened. The entire ink in the pressure chamber is gradually thickened, by the diffusion of the thickened ink in the pressure chamber due to the minute vibration operation.

In addition, such a problem is not limited to the printer, and the same problem occurs in other liquid ejecting apparatuses having a configuration of ejecting liquid including a component, sedimentation of which sometimes occurs.

An advantage of some aspects of the invention is to provide a liquid ejecting apparatus which can suppress ejecting malfunction of liquid, by suppressing thickening of liquid and efficiently executing a minute vibration operation, in a configuration of ejecting liquid including a component, sedimentation of which may occur, and to provide a controlling method thereof.

SUMMARY

According to an aspect of the invention, there is provided a liquid ejecting apparatus including: a liquid ejecting head which includes nozzles which eject liquid, a pressure chamber which communicates with the nozzles, and a pressure generation unit which generates pressure fluctuation in liquid in the pressure chamber, and which ejects liquid from the nozzles by driving of the pressure generation unit; and a driving signal generation unit which generates a minute vibration driving signal including a minute vibration waveform which is applied to the pressure generation unit to drive the pressure generation unit, and to generate pressure fluctuation in the liquid in the pressure chamber to a degree of not ejecting liquid from the nozzles, in which the minute vibration driving signal includes a first signal section which generates a plurality of minute vibration waveforms, and a second signal section which maintains potential to a constant level, and in which the liquid ejecting apparatus has a first mode in which duration of the second signal section is set to a first time longer than duration of the first signal section, and a second mode in which the duration of the second signal section is set to a second time longer than the first time.

According to the aspect of the invention, since the minute vibration driving signal includes the first signal section which generates the plurality of minute vibration waveforms, and the second signal section which maintains potential to a constant level, the minute vibration operation is stopped for a constant time by the second signal section for each time when the minute vibration operation is performed by the first signal section. Accordingly, it is possible to suppress thickening of the liquid and agitate the liquid, compared to a configuration of continuously performing the minute vibration operation without stopping during the operation. Thus, in the configuration of using the liquid containing a component, sedimentation of which readily occurs with relatively great specific gravity, it is possible to reduce generation of ejection failures caused by the sedimentation of the contained component. In addition, it is possible to extend an interval in which the apparatus can be left without performing maintenance such as ejection of the liquid from the nozzles or suction cleaning (so-called intermittent capacity). Accordingly, it is possible to decrease the execution frequency of the suction cleaning to suppress consumption of the liquid. Further, since the pressure generation unit is not continuously driven, degradation of the pressure generation unit is suppressed and it also contributes to power saving.

Since the liquid ejecting apparatus has the first mode in which duration of the second signal section is set to the first time longer than duration of the first signal section, and the second mode in which duration of the second signal section is set to the second time longer than the first time, at the time of activation when turning on the power of the liquid ejecting apparatus, for example, the minute vibration operation with an improved agitating effect is performed in the first mode, and accordingly the contained component which is sedimented when the power is turned off can be more efficiently diffused, and after the minute vibration operation in the first mode, the minute vibration operation for securing a longer stopping time is performed by switching to the second mode, and accordingly it is possible to further suppress the thickening of the liquid and to diffuse the liquid to suppress the sedimentation of the contained component. Thus, even in a state where the power is turned off over a longer period of time, the thickening of the liquid and the sedimentation of the contained component can be suppressed to reduce ejection failures.

According to the aspect of the invention, it is preferable that the minute vibration driving signal in the first mode or the minute vibration driving signal in the second mode be selected and applied with respect to the pressure generation unit corresponding to the nozzles which perform minute vibration.

According to the aspect of the invention, it is preferable that a minute vibration operation be executed by the minute vibration driving signal in the first mode, after applying power to the liquid ejecting apparatus.

According to the aspect of the invention, it is preferable that a minute vibration operation be executed by the minute vibration driving signal in the second mode, after the minute vibration operation is executed in the first mode.

According to the aspect of the invention, it is preferable that a flushing process of ejecting liquid from the nozzles be executed between the minute vibration operation in the second mode and an ejecting operation of ejecting liquid with respect to a landing target from the nozzles.

According to this configuration, since the thickened liquid in the liquid ejection head is discharged by performing the flushing process of ejecting liquid from the nozzles between the minute vibration operation in the second mode and the ejecting operation of ejecting liquid with respect to a landing target from the nozzles, the viscosity of the liquid can be recovered to an initial state (state in which liquid stored in a storage member such as a liquid cartridge) thereof. Accordingly, the ejection failures in the subsequent liquid ejection operation can be more reliably suppressed.

According to the aspect of the invention, it is preferable that an obstacle detection unit which detects concavities and convexities or an obstacle on a liquid landing surface of a landing target be further included, and the minute vibration operation in the second mode be executed after an obstacle detection operation is executed by the obstacle detection unit and until an ejecting operation of ejecting the liquid from the nozzles with respect to the landing target is available.

According to this configuration, since the minute vibration operation in the second mode is executed after an obstacle detection operation is executed by the obstacle detection unit and until an ejecting operation of ejecting the liquid from the nozzles with respect to the landing target is available, it is possible to agitate the liquid while suppressing the thickening, also in the operation of flattening of a surface of a landing target or removing the obstacle or the like on the surface of the landing target.

According to the aspect of the invention, it is preferable that a third mode which generates a minute vibration driving signal obtained only from the first signal section be set, and the minute vibration operation be executed in the third mode, after execution of an ejecting operation with respect to the landing target is designated and until the ejecting operation is available.

According to this configuration, since the minute vibration operation is continuously executed in the third mode after execution of the ejecting operation with respect to the landing target is designated and until the ejecting operation is available, it is possible to agitate the liquid to reach a state more suitable for the ejection operation.

According to the aspect of the invention, it is preferable that the minute vibration operation be executed in the second mode, after completion of the ejecting operation with respect to the landing target.

According to this configuration, since the minute vibration operation is executed in the second mode, after completion of the ejecting operation with respect to the landing target, and the liquid is agitated while suppressing the thickening of the liquid, until the next execution of the ejection operation is designated or until the power of the liquid ejecting apparatus is turned off, it is possible to suppress proceeding of the thickening of the liquid and the sedimentation of the contained component.

According to another aspect of the invention, there is provided a controlling method of a liquid ejecting apparatus which includes a liquid ejecting head which includes nozzles which eject liquid, a pressure chamber which communicates with the nozzles, and a pressure generation unit which generates pressure fluctuation in liquid in the pressure chamber, and which ejects liquid from the nozzles by driving of the pressure generation unit, and a driving signal generation unit which generates a minute vibration driving signal including a minute vibration waveform which is applied to the pressure generation unit to drive the pressure generation unit, and to generate pressure fluctuation in the liquid in the pressure chamber to a degree of not ejecting liquid from the nozzles, in which the minute vibration driving signal includes a first signal section which generates a plurality of minute vibration waveforms, and a second signal section which maintains potential to a constant level, and in which the controlling method has a first mode in which duration of the second signal section is set to a first time longer than duration of the first signal section, and a second mode in which duration of the second signal section is set to a second time longer than the first time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments for realizing the invention will be described with reference to the accompanied drawings. The embodiments which will be described below have various limitations as preferred specific examples of the invention, however, the scope of the invention is not limited to the embodiments, if not otherwise specified regarding the limitation of the invention in the following descriptions. In the following description, an ink jet type textile printing apparatus (hereinafter, textile printer) which can print a printed image such as an image or text by ejecting ink to a material to be printed such as a T-shirt (one kind of landing target) is used as an example of the liquid ejecting apparatus of the invention. The "material to be printed" means "textile" which is a target of printing, and includes fabrics such as natural fiber such as cotton, silk, or wool, chemical fiber such as nylon, or composite fiber obtained by mixing thereof, knit fabric, non-woven fabric, and the like.

Figure 1:
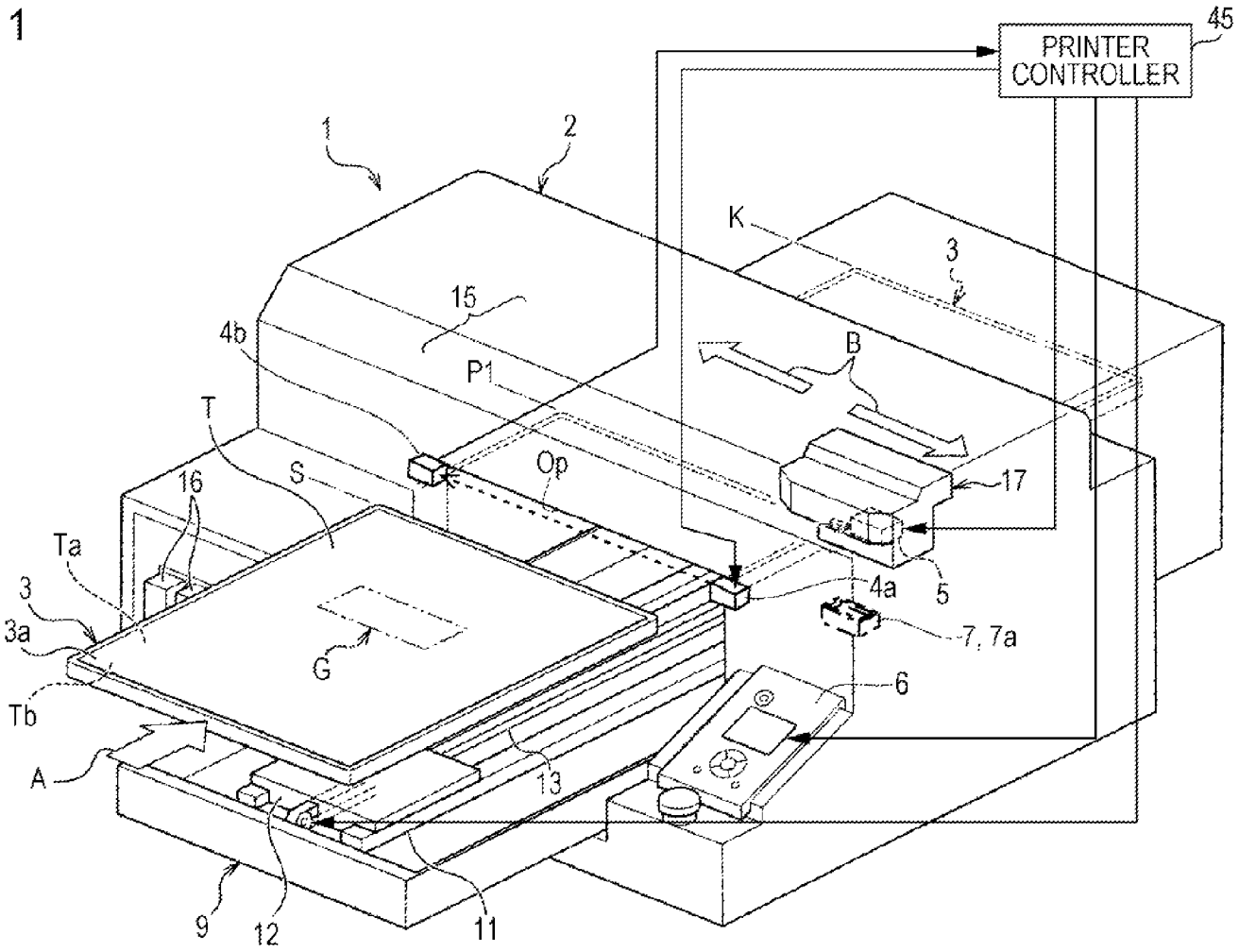
FIG. 1 is a perspective view illustrating a configuration of a textile printer.
Figure 2:
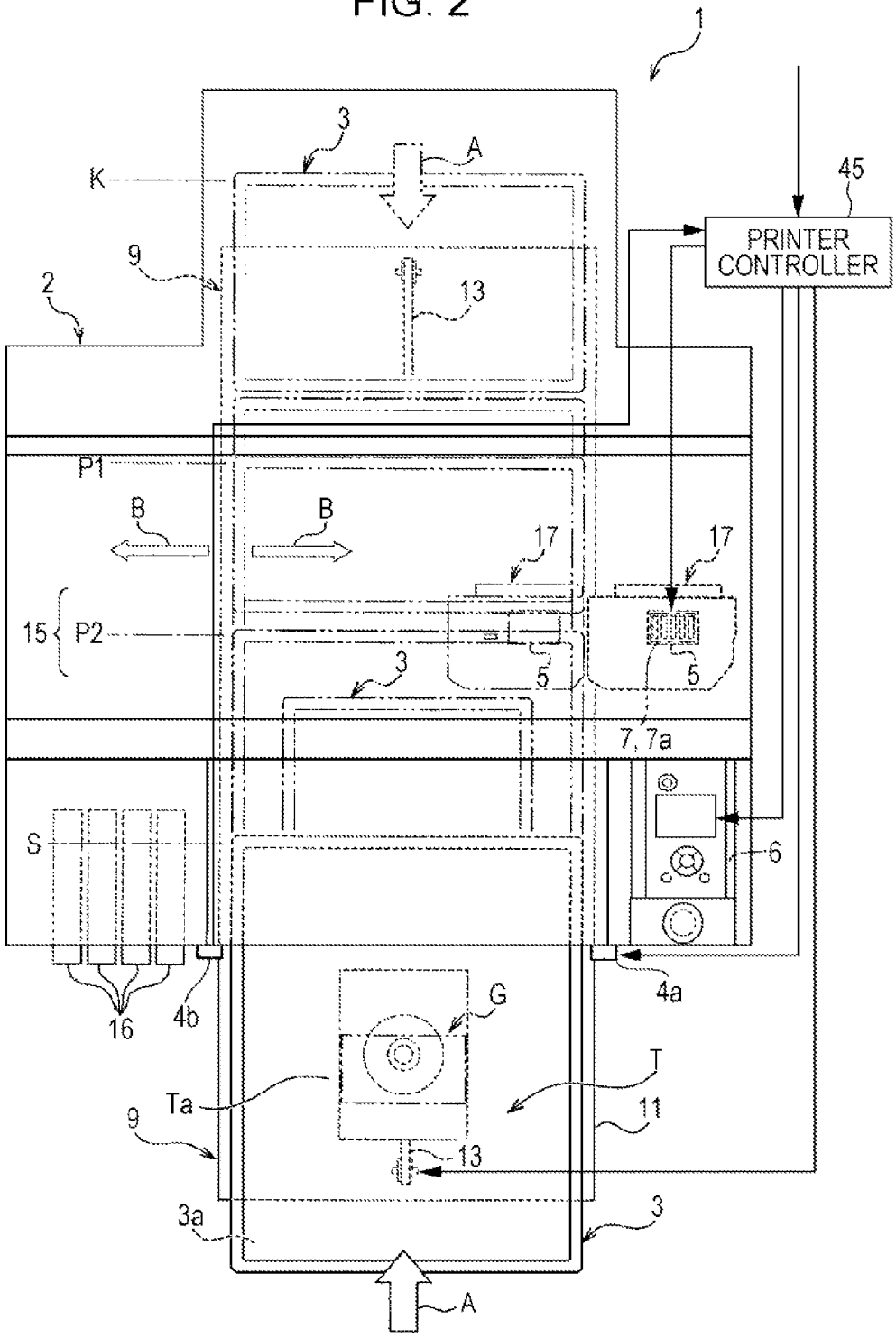
FIG. 2 is a plan view illustrating a configuration of a textile printer.
Figure 3:
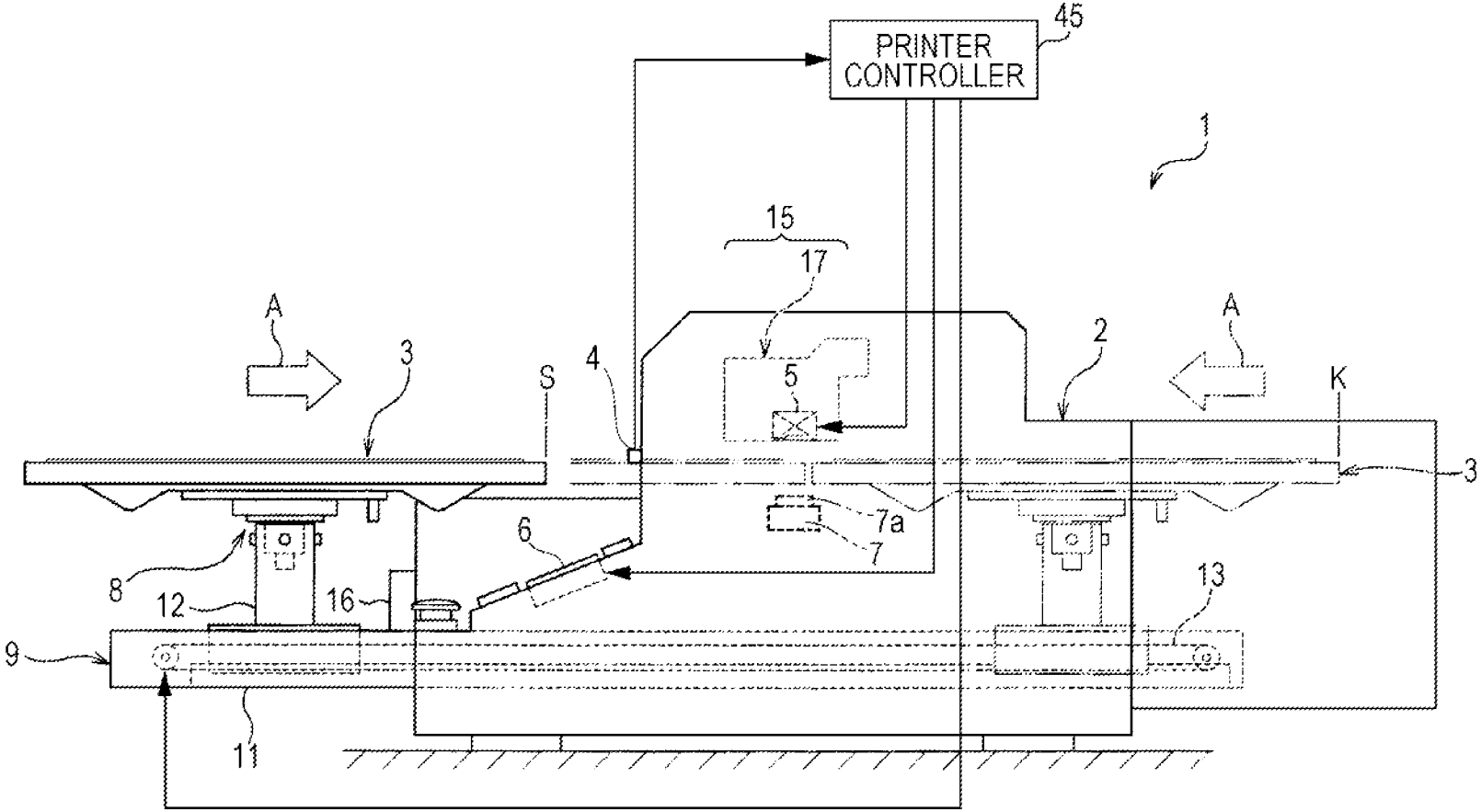
FIG. 3 is a side cross-sectional view illustrating a configuration of a textile printer.

FIG. 1 is a perspective view illustrating a basic configuration of a textile printer 1. FIG. 2 is a plan view of the textile printer 1 and FIG. 3 is a side cross-sectional view of the textile printer 1. The textile printer 1 of the embodiment includes a tray attachment unit 8 (see FIG. 3) on which a set tray 3 is detachably mounted, an obstacle detector 4 which can detect protrusions (obstacles) on a surface of a material to be printed T which is set in the set tray 3 on the tray attachment unit 8, a printer controller 45 which controls operations of each unit, and a manipulation panel unit 6 which includes manipulation buttons for receiving a designation manipulation from a user or a liquid crystal display unit for displaying predetermined information.

The surface of the material to be printed T described in the embodiment denotes a surface on which liquid ejected from nozzles is landed.

The textile printer 1 includes a printing head 5 (one kind of liquid ejecting head) which ejects ink to the material to be printed T to form a printed image G such as an image or a text, a carriage scanning unit 10 (see FIG. 5) which causes a carriage 17 on which the printing head 5 is mounted to perform reciprocation, and a movement unit 9 which moves the set tray 3. The set tray 3, for example, is formed of a rectangular flat plate-shape member, and a set surface 3*a* for setting the material to be printed T is formed on an upper surface thereof. The set surface 3*a* is a portion which supports a second surface Tb of the material to be printed T, and the entire surface thereof is formed to be flat so as to set the material to be printed T in a flat state.

The movement unit 9 includes a movement mechanism including a support base 11 which extends from the front to the back (rear side) of an apparatus main body 2 of the textile printer 1 along a movement direction A, a support 12 which includes a slider which is provided to reciprocate along the movement direction A in the center portion of the support base 11 and a support post having a predetermined height, and a timing belt 13 which drives the support 12. In addition, the set tray 3 is detachably attached to the tray attachment unit 8 on the upper surface of the support 12. The movement unit 9 is configured so as to move the set tray 3 described above between a set position S which is a position where the material to be printed T is attached or detached, and a printing start position K which is a position interposing a printing execution region 15 by the printing head 5. Detection of the obstacle on the surface of the material to be printed T performed by the obstacle detector 4 is configured to be executed when the set tray 3 is moved to the printing start position K from the set position S.

The obstacle detector 4 is configured with a pair of a light emitting element 4*a* and a light receiving element 4*b* which are provided on both sides of left and right (head movement direction) of a front surface opening portion Op (see FIG. 1) of the apparatus main body 2 through which the set tray 3 can pass. The light emitting element 4*a* is formed of a light emitting diode, for example, and emits light towards the light receiving element 4*b* which is positioned on an opposite side with the front surface opening portion of the apparatus main body 2 interposed therebetween, so as to be orthogonal with respect to a passing section of the material to be printed T which is set in the set tray 3. The light receiving element 4*b* is configured of a photodiode, for example, and outputs a detection signal according to a light receiving state or non-light receiving state with respect to the printer controller 45. In a case where there is an obstacle such as wrinkles or other concavities and convexities or foreign materials on the surface of the material to be printed T when moving the set tray 3 to the printing start position K from the set position S, since light is not received by the light receiving element 4*b* if the obstacle shields the light emitted from the light emitting element 4*a*, the detection signal changes according thereto. Accordingly, the printer controller 45 can detect the obstacle on the surface of the material to be printed T on the set tray 3, based on the change of the detection signal from the light receiving element 4*b* of the obstacle detector 4.

When it is determined that the obstacle is detected on the surface of the material to be printed T, based on the detection signal from the obstacle detector 4, the printer controller 45 performs control of returning the set tray 3 to the set position S without executing the printing operation performed by the printing head 5, and performs notification with respect to the user by displaying the detection of the obstacle on the surface of the material to be printed T, on the liquid crystal display unit of the manipulation panel unit 6. According to this notification, the user performs resetting by smoothing out the wrinkles on the material to be printed T which is set on the set tray 3 or by removing the foreign material. After completing the resetting, the obstacle detection is performed again by the obstacle detector 4 when moving the set tray 3 to the printing start position K from the set position S. In a case where the obstacle is not detected by the obstacle detector 4, the set tray 3 is moved to the printing start position K and the printing operation with respect to the material to be printed T performed by the printing head 5 is started from that position.

The printing head 5 is held by the carriage 17 in the apparatus main body 2. The carriage 17 is configured to be movable in a scanning direction B (main scanning direction) which is a direction intersecting with the movement direction A of the set tray 3 by the carriage scanning unit 10 (see FIG. 5). One end portion (right end portion in FIG. 2) of the carriage 17 in the scanning direction B is set to a home position, and a capping mechanism 7 which can seal a nozzle surface (surface of a nozzle plate 28 on an ink ejecting side) of the printing head 5 is disposed below the home position. The capping mechanism 7 is configured with a cap member 7*a* which is formed of a tray-shaped elastic material with an opened upper surface side, and a pump (not shown) which makes a pressure of an inner space of the cap member 7*a* in a state where the nozzle surface is sealed, be a negative pressure. In addition, the capping mechanism 7 is configured to be movable by a movement mechanism (not shown), and a mode thereof can be switched to a sealed state in which the cap member 7*a* seals the nozzle surface of the printing head 5 and a retraction state in which the cap member 7*a* is separated from the nozzle surface. More specifically, at the time of the standby state when the printing head 5 does not perform the printing operation with respect to the material to be printed T, or when the power of the textile printer 1 is turned off, the carriage 17 is positioned at the home position, and the nozzle surface of the printing head 5 is capped by the capping mechanism 7. Accordingly, evaporation of an ink solvent from nozzles 34 of the printing head 5 is suppressed. In addition, at the time of a flushing process which is an operation of forcibly discharging the thickened ink or the like in the printing operation by the printing head 5, the cap member 7*a* does not cap the nozzle surface in the retraction state, but functions as an ink reception unit which receives the ink ejected from the printing head 5. Further, in a maintenance operation (suction cleaning process) which is a process of removing the thickened ink or air bubbles in the printing head 5 to recover from clogging of the nozzles or the like, by operating the pump in the capping state to make the pressure of the internal space of the cap member 7*a* be a negative pressure, the ink or the air bubbles are forcibly discharged into the cap member 7*a* from the nozzles. The waste ink discharged to the cap member 7*a* is discharged to a waste ink tank (not shown).

The printing head 5 executes the printing by introducing ink supplied through a supply tube or the like from an ink cartridge 16 mounted on a front surface side of the apparatus main body 2 to an inner portion thereof and ejecting the introduced ink towards a first surface Ta of the material to be printed T to land the ink. In the embodiment, a so-called serial type printing head 5 is employed which ejects the ink with respect to the material to be printed T while reciprocating in the scanning direction B of the carriage 17.

Figure 4:
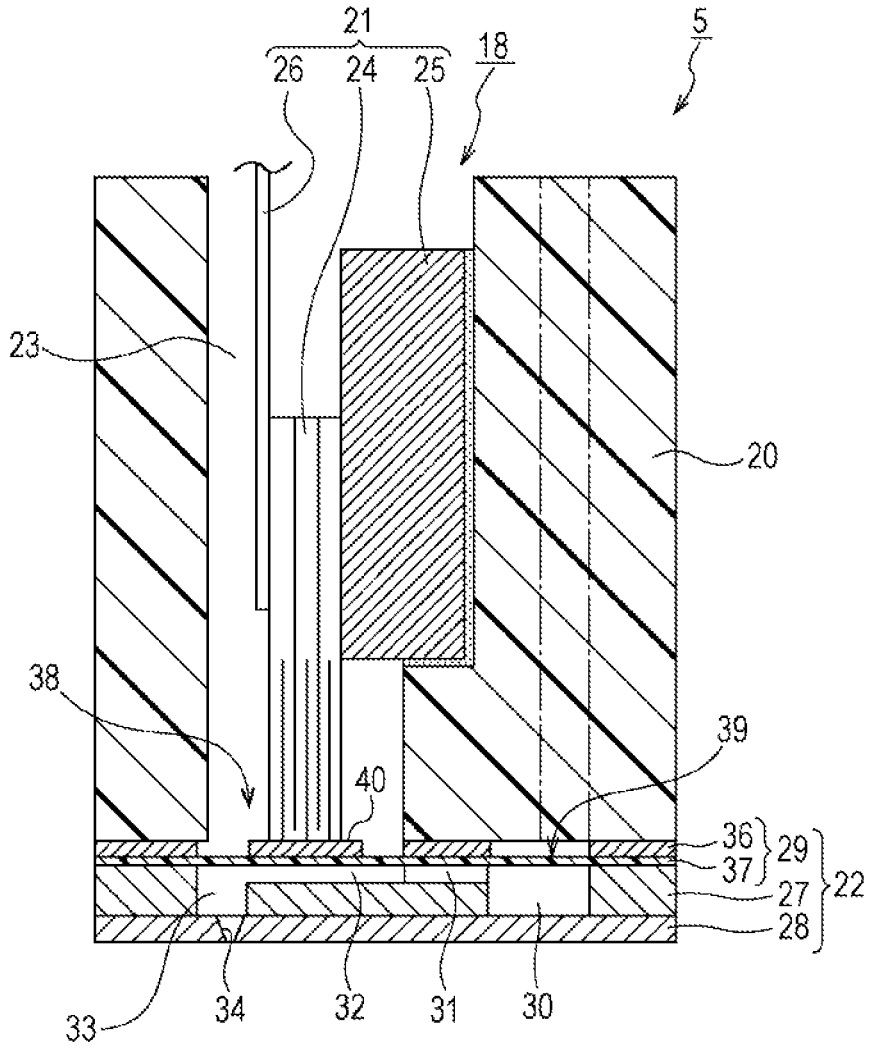
FIG. 4 is a cross-sectional view of a main part illustrating an internal configuration of a printing head.

FIG. 4 is a cross-sectional view of the main part illustrating the internal configuration of the printing head 5.

The printing head 5 of the embodiment includes a case 20, a vibrator unit 21 which is accommodated in the case 20, and a flow path unit 22 which is joined with a bottom surface (tip end surface) of the case 20. The case 20 is, for example, manufactured using an epoxy resin, and an accommodation empty portion 23 for accommodating the vibrator unit 21 is formed therein. The vibrator unit 21 includes a piezoelectric element 24 which functions as one kind of pressure generation unit, a fixing plate 25 which is joined with the piezoelectric element 24, and a flexible cable 26 for supplying the driving signal or the like to the piezoelectric element 24. The piezoelectric element 24 is a laminated type manufactured by cutting the piezoelectric plate obtained by alternately laminating a piezoelectric layer and an electrode layer, to a comb shape, and is a piezoelectric vibrator of a so-called longitudinal vibration type which is extendable in a direction perpendicular to a lamination direction.

The flow path unit 22 is configured by joining the nozzle plate 28 to one surface of a flow path forming substrate 27, and a vibrating plate 29 to the other surface of the flow path forming substrate 27, respectively. The flow path unit 22 is provided with a reservoir 30 (common liquid chamber), an ink supply port 31, a pressure chamber 32, a nozzle communication port 33, and a nozzle 34. A series of an ink flow path from the ink supply port 31 to the pressure chamber 32, the nozzle communication port 33, and the nozzle 34 is formed corresponding to each nozzle 34.

The nozzle plate 28 is a thin plate formed of metal such as stainless steel or a silicon single crystal substrate on which the plurality of nozzles 34 are provided by being bored in a row with a pitch corresponding to a dot formation density. The plurality of rows of the nozzle 34 (nozzle row) are provided on this nozzle plate 28, and one nozzle row is configured with 180 nozzles 34, for example. In the printing head 5 of the embodiment, ink (one kind of liquid of the invention) of a plurality of different colors, specifically ink of 6 colors in total obtained by adding white ink (W) and silver ink (S), to ink of 4 colors of cyan (C), magenta (M), yellow (Y), and black (K), are used. Six nozzle rows in total are formed on the nozzle plate 28 corresponding to these colors.

Herein, the white ink is ink containing a white pigment component, and is one kind of white liquid. As the white pigment, titanium dioxide can be preferably used, for example. In addition, the silver ink is ink containing a gloss pigment component, and is one kind of gloss liquid. As the gloss pigment, a powder-like or paste-like metal pigment formed of metal such as aluminum, or a pearl pigment formed of titanated mica obtained by coating a surface of mica with metal oxide, can be used for example. The "white" is a color which is visually recognized as white, is not limited to achromatic white, and has a meaning including slightly tinged white such as off-white or ivory white, for example. In addition, "gloss liquid" means liquid including a pigment which can allow visual recognition of gloss in a recorded image by reflecting light.

The vibrating plate 29 has a double structure in which an elastic film 37 is laminated on the surface of a supporting plate 36. In the embodiment, the vibrating plate 29 is configured by a composite plate material obtained by laminating a stainless steel plate which is one kind of metal plate as the supporting plate 36, and a resin film provided on the surface of the supporting plate 36 as the elastic film 37. A diaphragm portion 38 which changes volume of the pressure chamber 32 is provided on the vibrating plate 29. In addition, a compliance portion 39 which seals a part of the reservoir 30 is provided on the vibrating plate 29.

The diaphragm portion 38 is manufactured by partially removing the supporting plate 36 by etching treatment. That is, the diaphragm portion 38 is formed of an island portion 40 which is joined with a tip end surface of the piezoelectric element 24 and a thin elastic portion surrounding the island portion 40. The compliance portion 39 is manufactured by removing the supporting plate 36 on a region opposing the opening surface of the reservoir 30 by the etching treatment in the same manner as the diaphragm portion 38, and functions as a damper which absorbs pressure fluctuation of the liquid stored in the reservoir 30.

Since the tip end surface of the piezoelectric element 24 is joined with the island portion 40, the volume of the pressure chamber 32 can be fluctuated by expanding and contracting the piezoelectric element 24. The pressure of the ink in the pressure chamber 32 fluctuates according to this volume fluctuation. In addition, the printing head 5 ejects ink droplets from the nozzle 34 using this pressure fluctuation.

Figure 5:
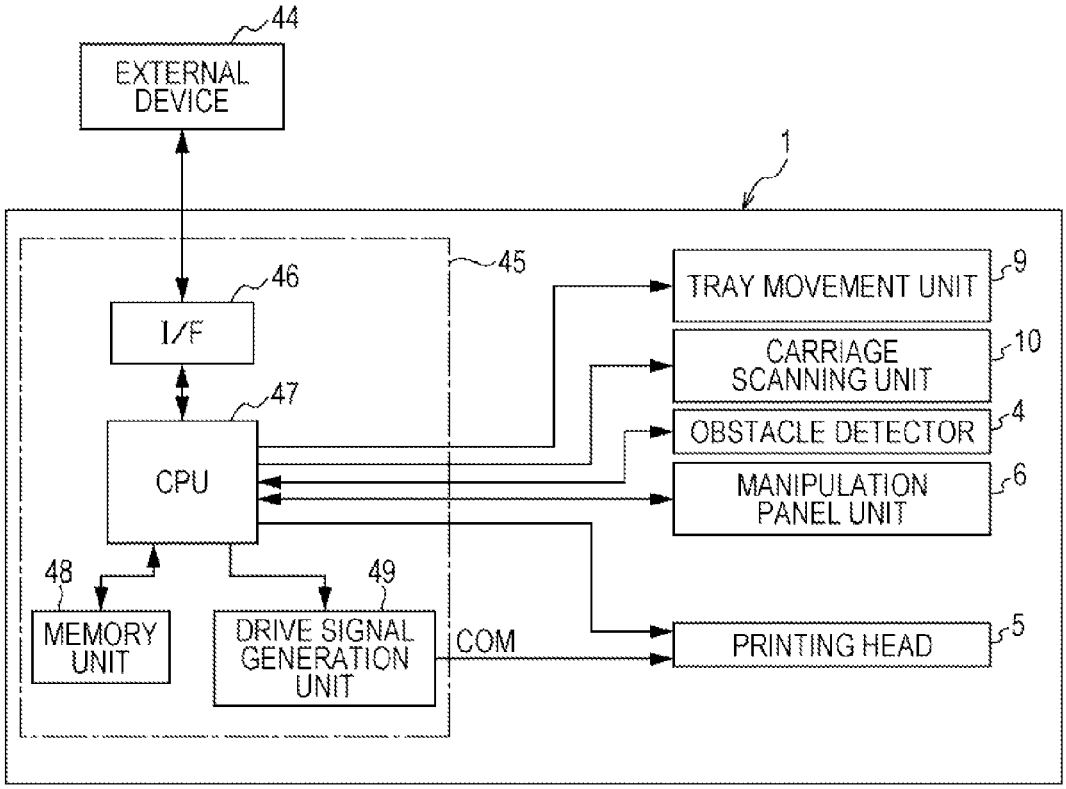
FIG. 5 is a block diagram illustrating an electrical configuration of a textile printer.

FIG. 5 is a block diagram illustrating an electrical configuration of the textile printer 1. An external device 44 is an electronic device which handles images, such as a computer, a digital camera, or a mobile phone, for example. This external device 44 is connected to the textile printer 1, and for printing an image or text on the material to be printed T in the textile printer 1, the external device transmits printing data corresponding to the image or the like to the textile printer 1.

The textile printer 1 of the embodiment includes the movement unit 9, the carriage scanning unit 10, the obstacle detector 4, the manipulation panel unit 6, the printing head 5, and the printer controller 45.

The printer controller 45 is one kind of a control unit, and is a control unit which performs control of each unit. The printer controller 45 includes an interface (I/F) unit 46, a CPU 47, a memory unit 48, and a driving signal generation unit 49. The interface unit 46 performs transmission and reception of printer state data, for example, transmitting of printing data or a printing command from the external device 44 to the textile printer 1 or receiving state information of the textile printer 1 by the external device 44. The CPU 47 is an arithmetic processing unit for performing control of the entire printer. The memory unit 48 is an element for recording a program of the CPU 47 or data used for various control operations, and includes a ROM, a RAM, and a NVRAM (non-volatile memory element). The CPU 47 controls each unit according to the program stored in the memory unit 48.

The driving signal generation unit 49 is a unit which functions as the driving signal generation unit of the invention, and generates an analog voltage signal based on waveform data related to a waveform of a driving signal. In addition, the driving signal generation unit 49 amplifies the voltage signal described above to generate a driving signal. In addition to generating a driving signal used in the printing operation (one kind of the ejection operation of the invention) of ejecting the ink from the nozzle 34 of the printing head 5 with respect to the material to be printed T to print the printed image G, the textile printer 1 of the embodiment is configured to generate a minute vibration driving signal vCOM (see FIG. 6) used in the minute vibration operation of agitating the ink in the pressure chamber 32 of the printing head 5 or the meniscus of the nozzle 34 in the standby state, other than the printing operation.

Figure 6A:
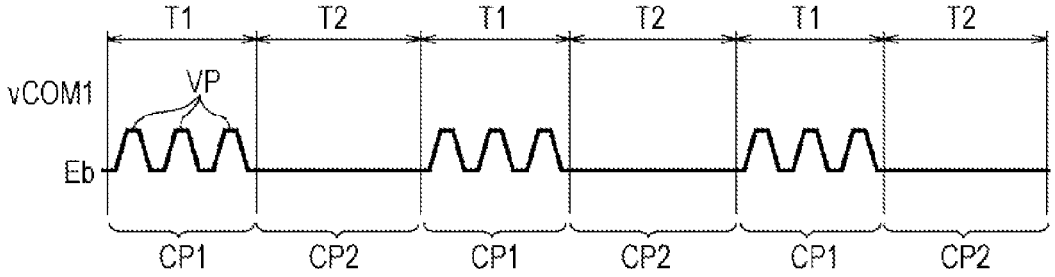
FIGS. 6A to 6C are waveform diagrams illustrating a configuration of a minute vibration driving signal.
Figure 6B:
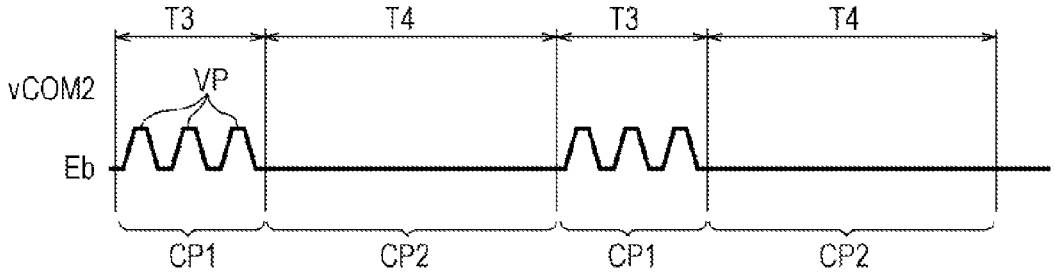
Figure 6C:
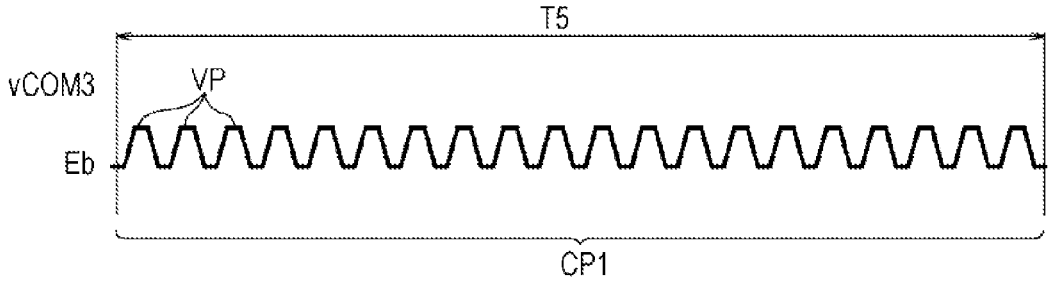

FIGS. 6A to 6C are waveform diagrams illustrating one example of the configuration of the minute vibration driving signal vCOM.

The textile printer 1 according to the invention is configured to set three types of modes, and the driving signal generation unit 49 generates three types of minute vibration driving signals vCOM according to each mode. More specifically, the driving signal generation unit 49 generates a first minute vibration driving signal vCOM1 corresponding to a first mode, a second minute vibration driving signal vCOM2 corresponding to a second mode, and a third minute vibration driving signal vCOM3 corresponding to a third mode.

A minute vibration driving pulse VP (one kind of minute vibration waveform of the invention) which generates the pressure fluctuation in the ink in the pressure chamber 32 to a degree of not ejecting the ink from the nozzle 34 is generated in each minute vibration driving signal vCOM.

Figure 7:
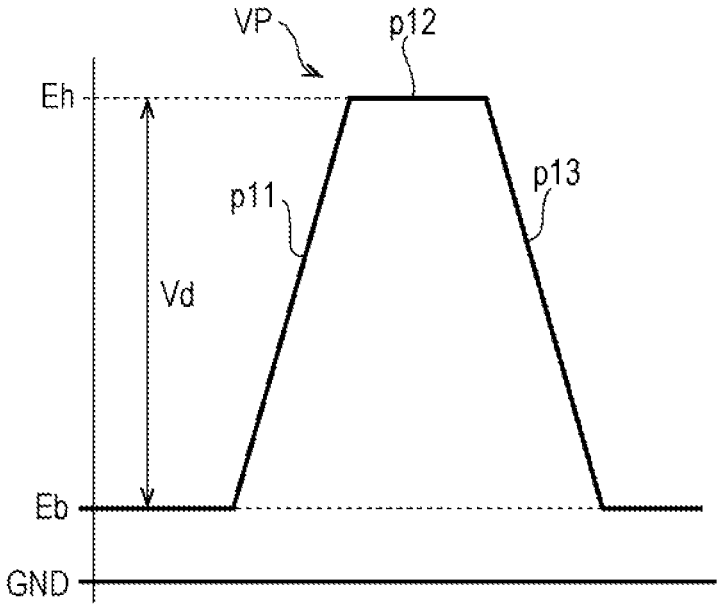
FIG. 7 is a waveform diagram illustrating a configuration of a minute vibration driving pulse.

FIG. 7 is a waveform diagram illustrating one example of the configuration of the minute vibration driving pulse VP. The minute vibration driving pulse VP is configured with a first potential changing portion p11 which changes potential to a positive side (first polarity side) from a reference potential Eb to a minute vibration potential Eh, a potential maintaining portion p12 which maintains the minute vibration potential Eh for a predetermined time period, and a second potential changing portion p13 which changes the potential from the minute vibration potential Eh to a negative side (second polarity side) to return to the reference potential Eb.

A driving voltage of the minute vibration driving pulse VP, that is a difference of potential Vd between the reference potential Eb and the minute vibration potential Eh is set to an optimal value for agitating the ink in the pressure chamber 32. In addition, a rate of change of the potential of the first potential changing portion p11 per unit time is set to a value with a degree of not ejecting the ink from the nozzle 34. In the same manner, a rate of change of the potential of the second potential changing portion p13 is set to a value with a degree of not ejecting the ink from the nozzle 34.

If the minute vibration driving pulse VP is supplied to the piezoelectric element 24, first, the piezoelectric element 24 is contracted by the first potential changing portion p11 to expand the pressure chamber 32 to a degree of not ejecting the ink droplets from the nozzle 34. The expanded state of the pressure chamber 32 is maintained for the predetermined time by the potential maintaining portion p12. After that, the second potential changing portion p13 is supplied, and accordingly, the piezoelectric element 24 is extended to contract the pressure chamber 32 to the original state (state corresponding to the reference potential Eb) to return the volume of the pressure chamber to the reference volume. With this series of operations, the pressure fluctuation with a degree of not ejecting the ink of the pressure chamber 32 from the nozzle 34 is generated, and the ink in the pressure chamber 32 and the meniscus minutely vibrates according to this pressure fluctuation. That is, the ink in the pressure chamber 32 and the ink in the vicinity of the nozzle 34 are agitated by this minute vibration operation. The thickened ink or sedimented pigment component in the pressure chamber 32 or the vicinity of the nozzle 34 is diffused by this minute vibration operation.

The first minute vibration driving signal vCOM1 is a driving signal in which a first signal section CP1 in which the plurality of minute vibration driving pulses VP are continuously generated at regular intervals, and a second signal section CP2 in which the minute vibration driving pulse VP is not generated and the potential is constantly maintained at the reference potential Eb, are alternately generated. That is, the first minute vibration driving signal vCOM1 is a driving signal for performing the minute vibration operation for duration T1 with the first signal section CP1 and then stopping the minute vibration operation for duration T2 with the second signal section CP2. In FIG. 6, the number of minute vibration driving pulses VP generated in the first signal section CP1 is schematically shown as 3 for convenience sake, however, practically more minute vibration driving pulses VP are generated. Herein, the duration T1 of the first signal section CP1 is set to a time of a degree of sufficiently agitating in the sedimented pigment component and not excessively allowing the thickening of the ink to proceed due to the minute vibration operation. The duration T1 is determined according to the type of the ink or the environment such as a temperature. That is, with the configuration of using the ink containing the pigment component, sedimentation of which more readily occurs, or under the state in which the temperature is low and the viscosity is relatively high, the duration T1 is set to be long, and with the configuration of using the ink containing the pigment component, sedimentation of which does not readily occur compared to the ink described above, or in the state in which the temperature is high and the viscosity is relatively low, the duration T1 is set to be short. On the other hand, the duration T2 (or minute vibration stopping time which corresponds to the first time of the invention) of the second signal section CP2 is set to have a ratio of 1 to 100 with respect to the duration T1.

The first mode of performing the minute vibration operation using the first minute vibration driving signal vCOM1 is set at the time of activation when the power of the textile printer 1 is turned on, and is set in a state where the nozzle surface of the printing head 5 positioned in the home position is capped by the capping mechanism 7. The execution time of the first mode is set to a value (regulated execution time) according to the time from the previous turning-off to the next turning-on of the power, in a range up to 20 minutes maximum from the time of activation, for example. That is, as the time for which the power has been turned off becomes longer, the regulated execution time of the first mode is set to be longer. In the execution of the minute vibration operation in the first mode, even when the execution designation of the printing operation or the other maintenance is performed with respect to the printer controller 45, the operation does not transition to another operation such as the printing operation, until the regulated execution time ends.

In addition, in the same manner as the first minute vibration driving signal vCOM1, the second minute vibration driving signal vCOM2 is a driving signal in which the first signal section CP1 and the second signal section CP2 are alternately generated. The second minute vibration driving signal vCOM2 is a driving signal for performing the minute vibration operation for duration T3 with the first signal section CP1 and then stopping the minute vibration operation for duration T4 with the second signal section CP2. The duration T3 of the first signal section CP1 of the second minute vibration driving signal vCOM2 is set to a time of not excessively allowing the thickening of the ink to proceed due to the minute vibration operation, and is set to a value which is the same as the duration T1 of the first signal section CP1 of the first minute vibration driving signal vCOM1. On the other hand, the duration T4 (which corresponds to the second time of the invention) of the second signal section CP2 of the second minute vibration driving signal vCOM2 is a time with a ratio of 50 to 3600 with respect to the duration T3, for example, and is set to be longer than the duration T2 of the second signal section CP2 of the first minute vibration driving signal vCOM1. The second mode of performing the minute vibration operation using the second minute vibration driving signal vCOM2 is operated at the time other than the execution of the first mode at the time of activation of power, and is set in a state where the nozzle surface of the printing head 5 positioned in the home position is capped by the capping mechanism 7.

The third minute vibration driving signal vCOM3 is a driving signal for generating only the first signal section CP1, unlike the first minute vibration driving signal vCOM1 and the second minute vibration driving signal vCOM2. The third mode of performing the minute vibration operation using the third minute vibration driving signal vCOM3 is set in a state where the nozzle surface of the printing head 5 is released from the capping state set by the capping mechanism 7, until the execution designation of the printing operation or the other maintenance is performed and the printing operation or the like can be executed. Duration T5 of the first signal section CP1 of the third minute vibration driving signal vCOM3 fluctuates according to the time from the execution designation of the printing operation until the printing operation can be executed.

Figure 8:
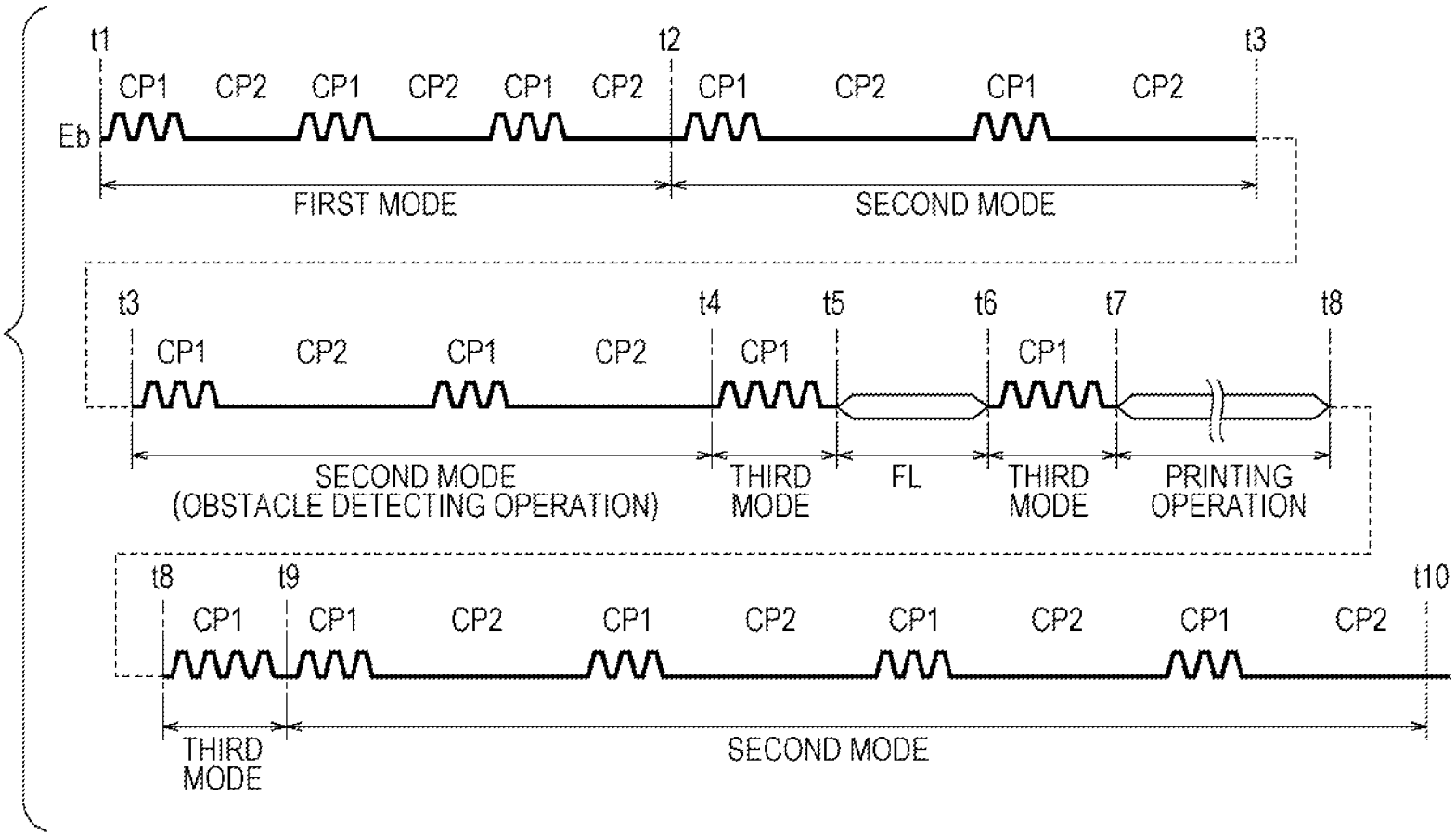
FIG. 8 is a timing chart illustrating an operation of a textile printer.

FIG. 8 is a timing chart illustrating one example of the minute vibration operation of the textile printer 1. If the state of the textile printer 1 is switched from the power-off state to the power-on state at a time point t1, the activation operation is started. At that time, the mode is set to the first mode, and the piezoelectric element 24 corresponding to each nozzle of the printing head 5 is driven by the first minute vibration driving signal vCOM1 in a state where the nozzle surface of the printing head 5 is capped, to execute the minute vibration operation. As described above, in the minute vibration operation in the first mode, until the regulated time has passed, even when the execution designation of the printing operation or other maintenance is performed, the operation does not transition to another operation such as the printing operation, until the set execution time ends. In the first mode, since the minute vibration operation with the first signal section CP1 is performed at a higher frequency than the second mode, the ink sedimented at the time of power-off is diffused while suppressing the thickening of the ink.

If the regulated execution time of the first mode is ended at a time point t2, the execution of the minute vibration operation in the second mode is subsequently started in a state where the nozzle surface of the printing head 5 is capped. In the second mode, since the duration T4 of the second signal section CP2 is set to be longer than the duration T2 of the second signal section CP2 of the first mode, the sedimentation of the pigment component in the ink is suppressed while further reliably suppressing the thickening of the ink. When executing the minute vibration operation in the second mode, in a case where the execution designation of the printing operation is performed with respect to the printer controller 45 at a time point t3, in the embodiment, the detection of concavities and convexities or an obstacle on the surface of the material to be printed T is executed by the obstacle detector 4. The minute vibration operation in the second mode is continued in the state where the nozzle surface of the printing head 5 is capped, until an obstacle or the like is not detected and it is finally determined that the printing operation can be performed. Accordingly, even in the operation where the user performs the smoothing out of the wrinkles on the surface of the material to be printed T or the removing of the foreign material on the surface of the material to be printed T, it is possible to agitate in the sedimented component while suppressing the thickening of the ink.

If an obstacle is not detected and it is determined that the printing operation can be performed at a time point t4, the nozzle surface of the printing head 5 is released from capping by the capping mechanism 7, and the flushing process (FL) is subsequently performed at a time point t5. The minute vibration operation in the third mode is continuously performed during the time between the time point t4 and the time point t5. Accordingly, the ink is sufficiently diffused. Thus, the ink can be agitated to a state more suitable for the printing operation. The flushing process described above is an operation of discharging the thickened ink or the air bubbles to the ink reception unit such as the cap member 7*a*, by performing idle-ejecting of the ink from the nozzle 34 by a driving pulse only for the flushing, separately from the ejecting operation intended for the printing of the image with respect to the material to be printed T. Since the thickened ink in the vicinity of the nozzle 34 or in the pressure chamber 32 is discharged by executing this flushing process before transition to the printing operation, the state of the viscosity of the ink in the nozzle 34 and in the pressure chamber 32 is recovered to a state close to the initial state (state of being stored in the ink cartridge). The minute vibration operation in the third mode is continuously performed during the time between a time point t6 at which the flushing process ends, and a time point t7 at which the carriage 17 is moved towards the printing execution region 15 from the home position to end the preparation for starting the printing operation. Accordingly, the ink is sufficiently diffused to the degree of the ejection problems not occurring when performing the printing operation.

If the printing operation is started from the time point t7, a driving signal only for performing formation of the image with respect to the material to be printed T is generated from the driving signal generation unit 49 and output to the printing head 5, and the piezoelectric element 24 is driven by this driving signal to perform the printing operation. The minute vibration driving pulse is included in this driving signal, in addition to an ejection driving pulse for performing ejection of the ink, and is applied to the piezoelectric element 24 corresponding to the nozzle 34 from which the ink is not ejected in the printing operation, such that the minute vibration (so-called minute vibration in printing) is performed. If the printing operation ends at a time point t8, the minute vibration operation in the third mode is continuously performed while the carriage 17 is moved towards the home position from the printing execution region 15. If the carriage 17 is positioned in the home position at a time point t9, the nozzle surface of the printing head 5 is capped by the capping mechanism 7, and the execution of the minute vibration operation in the second mode is started in the capped state. The minute vibration operation in the second mode is performed until the next execution designation of printing operation or maintenance operation is performed or until the power of the textile printer 1 is turned off.

As described above, since the textile printer 1 of the invention has a configuration of performing the minute vibration operation using the minute vibration driving signal for alternately generating the first signal section CP1 and the second signal section CP2, the minute vibration operation is stopped for a constant time for each time when the minute vibration operation is performed for the predetermined time. Accordingly, it is possible to suppress thickening of the ink and agitate the ink, compared to a configuration of continuously performing the minute vibration operation without stopping during the operation. Thus, in the configuration of using the ink containing the pigment, sedimentation of which readily occurs with relatively great specific gravity, it is possible to reduce generation of ejection failures caused by the sedimentation of the pigment. In addition, it is possible to extend an interval in which the apparatus can be left without performing maintenance such as ejection of the ink from the nozzles 34 or suction cleaning (so-called intermittent capacity). Accordingly, it is possible to decrease the execution frequency of the suction cleaning to suppress consumption of the ink. Further, since the piezoelectric element 24 is not continuously driven, degradation of the piezoelectric element 24 is suppressed and it also contributes to power saving.

Since the first mode in which the duration T2 of the second signal section CP2 is set to be longer than the duration T1 of the first signal section CP1, and the second mode in which the duration T4 of the second signal section CP2 is longer than the duration T2 of the first mode are included, and the mode can be selected among them, at the time of activation when turning on the power of the textile printer 1, for example, the minute vibration operation with an improved agitating effect is performed in the first mode, and accordingly the pigment which is sedimented when the power is turned off can be more efficiently diffused, and after the minute vibration operation in the first mode, the minute vibration operation for securing a longer stopping time is performed by switching to the second mode, and accordingly it is possible to further suppress the thickening of the ink and to diffuse the ink to suppress the sedimentation. Thus, even in a state where the power is turned off over a longer period of time, the thickening of the ink and the sedimentation of the pigment can be suppressed to reduce ejection failures.

Figure 9:
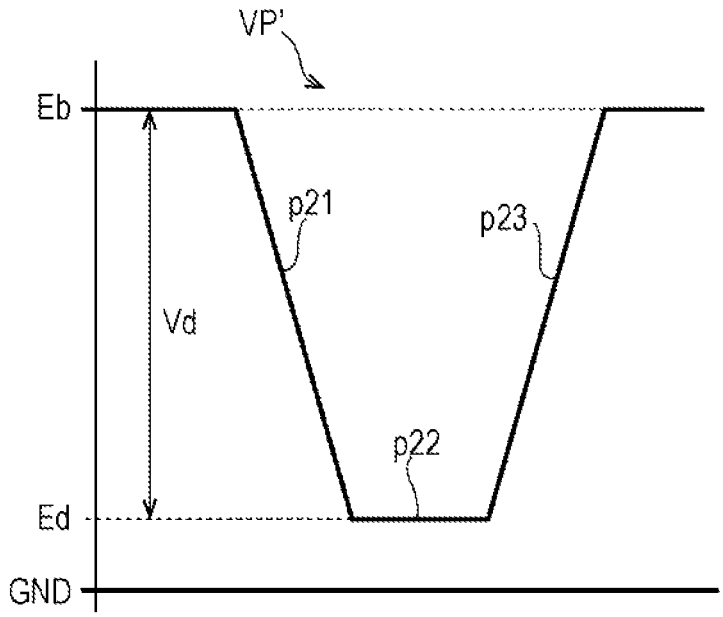
FIG. 9 is a waveform diagram illustrating a modification example of a minute vibration driving pulse.

In the embodiment, the configuration in which the minute vibration driving pulse VP includes the first potential changing portion p11 which changes potential to a positive side with respect to the reference potential, and the potential maintaining portion p12 which maintains the potential, and the second potential changing portion p13 which changes the potential to a negative side to return to the reference potential, has been exemplified, however, it is not limited thereto. For example, as a minute vibration driving pulse VP' shown in FIG. 9, a configuration of including a third potential changing portion p21 which changes the potential to a negative side with respect to the reference potential Eb, a second potential maintaining portion p22 which maintains the potential, and a fourth potential changing portion p23 which returns the potential to the reference potential, can be used.

In addition, in each embodiment, the so-called longitudinal vibration type piezoelectric element 24 has been used as the pressure generation unit, however, it is not limited thereto, and a so-called flexural vibration type piezoelectric element can be used. In this case, the upside down waveform, that is, the changed direction of the potential regarding the exemplified driving signals, is used.

In addition, in the embodiment, the duration T1 of the first signal section CP1 of the first minute vibration driving signal vCOM1 is set to a value the same as the duration T3 of the first signal section CP1 of the second minute vibration driving signal vCOM2, however, it is not limited thereto, and they may be different values from each other.

In the embodiment, the ejection problems due to the sedimentation of the coloring material (pigment) are exemplified, however, it is not limited thereto. For example, it is effective with respect to a material existing in the ink as a solid, such as resin particles, a wax agent, a preservative, or the like.

Next, a second embodiment of the invention will be described.

Figure 10:
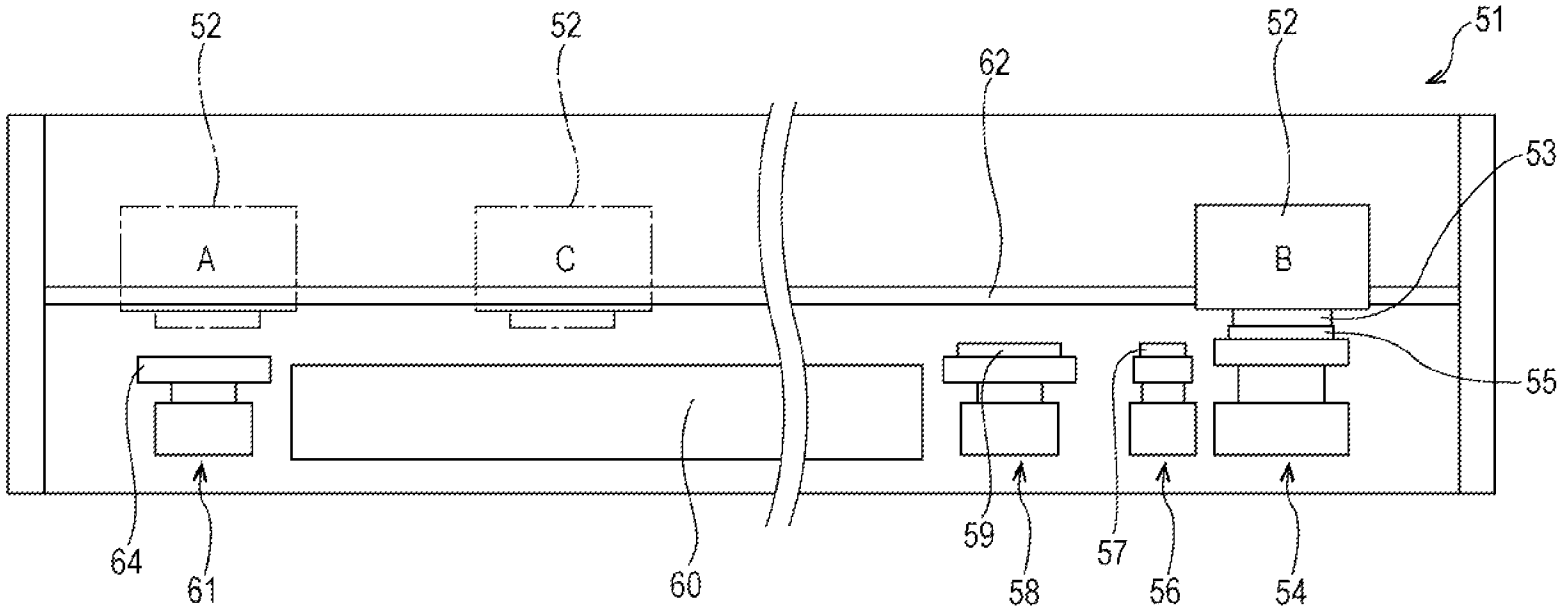
FIG. 10 is a front view illustrating an internal configuration of a printer of a second embodiment.

FIG. 10 is a front view illustrating an internal configuration of a printer 51 (one kind of liquid ejecting apparatus) of the embodiment. In the printer 51, a recording head 53 which is one kind of the liquid ejecting head is mounted on a carriage 52, and is attached to a guide lot 62 which can reciprocate in a main scanning direction (right and left direction in FIG. 10) in the equipment. In the printer 51, the recording head 53 ejects the ink from a nozzle of the recording head 53 while relatively moving in the main scanning direction, with respect to a recording medium (liquid landing target) such as a sheet which is transported and loaded on a platen 60, to land the ink on the recording medium, and accordingly the image or the like is recorded and printed. The configuration of the recording head 53 is a configuration which is generally the same as the printing head 5 of the first embodiment described above. In addition, the configuration of the driving signals for driving the piezoelectric element of the recording head 53 and each mode at the time of executing the minute vibration are also the same as those of the first embodiment.

A home position which is a standby position of the recording head 53 is set in a position deviated to one end side (right side in FIG. 10) in the main scanning direction with respect to the platen 60. A capping mechanism 54 (capping unit), an absorption capping mechanism 56 (absorption unit), and a wiping mechanism 58 (wiping unit) are provided in sequence from one end side, in the home position. In addition, a flushing box 61 as a flushing region is provided on the other end portion (left side in FIG. 10) in the main scanning direction from the home position with the platen 60 interposed therebetween. The capping mechanism 54 includes a cap 55 which is formed of an elastic member such as an elastomer, for example, and is configured to convert the state of the cap 55 to a state of abutting to the nozzle surface of the recording head 53 for sealing (capped state) or a retraction state of being separated from the nozzle surface. The cap 55 is formed in a tray shape with the opened surface on the side abutting to the nozzle surface of the recording head 53, and is designed to have a size so as to cover the entire nozzle of the nozzle surface. That is, in a case where a plurality of nozzle rows (nozzle groups) formed of the plurality of nozzles are arranged on the nozzle surface, the cap is configured so as to cover the entire nozzle rows in the capped state. At the time of standby when the power of the printer 51 is turned off, the nozzle surface of the recording head 53 is capped, and accordingly the evaporation of the ink solvent form the nozzle is suppressed. The cap 55 of the capping mechanism 54 can be replaced by a user.

The absorption capping mechanism 56 includes an absorption cap 57, and is configured to convert the state of the absorption cap 57 to a state of abutting to the nozzle surface of the recording head 53 (capped state) or a retraction state of being separated from the nozzle surface, in the same manner as the capping mechanism 54. In the same manner as the cap 55, the absorption cap 57 is formed in a tray shape with the opened surface on the side abutting to the nozzle surface, by an elastic member such as an elastomer. The size of the absorption cap 57 is designed to be a size so as to cover a region of one nozzle row. In addition, although not shown in the drawing, the absorption capping mechanism 56 includes a liquid discharging tube and an absorption pump provided in the middle of the liquid discharging tube. One end of the liquid discharging tube is connected to the absorption cap 57, and the other end thereof communicates with a liquid discharging tank (not shown). The absorption capping mechanism 56 operates the absorption pump in a state where the region corresponding to the nozzle row of the absorption target on the nozzle formation surface is capped by the absorption cap 57, to make the pressure in a sealed empty portion of the absorption cap 57 be a negative pressure. Thus, it is configured to perform a so-called cleaning process of discharging the thickened ink or air bubbles from the nozzle of the capped nozzle row. By changing the capped position with respect to the nozzle surface, it is possible to sequentially perform the cleaning process with respect to each nozzle row. The absorption cap 57 of the absorption capping mechanism 56 is set not to be replaced unlike the cap 55 of the capping mechanism 54, however, cleaning maintenance such as wiping of the ink is performed by a user depending on the situation. In addition, a configuration in which the capping mechanism 54 has the absorption function, without separately providing the absorption capping mechanism 56, can also be employed.

The wiping mechanism 58 includes a wiper 59 movable along a direction (nozzle row direction) intersecting the main scanning direction, and is configured to convert the state of the wiper 59 to a state of abutting to the nozzle surface of the recording head 53 or a retraction state of being separated from the nozzle surface. The wiper 59 is formed of a material obtained by coating a surface of an elastic blade main body with fabric. The wiping mechanism 58 wipes the nozzle surface by sliding from one side of the nozzle row to the other side, in a state of the wiper 59 abutting the nozzles surface. The wiper 59 can be replaced by a user.

The flushing box 61 includes a tray-shaped ink reception unit 64 which receives ink ejected at the time of the flushing process of forcibly ejecting the ink from the nozzle of the recording head 53 regardless of the recording operation with respect to the recording medium. The position of the ink reception unit 64 is fixed. The ink reception unit 64 is connected to one end of the liquid discharging tube (not shown), and communicates with the liquid discharging tank described above. In addition, the absorption pump is provided in the middle of the liquid discharging tube, and by operating the absorption pump, the ink in the ink reception unit 64 is discharged to the liquid discharging tank through the liquid discharging tube.

Next, the process of the printer 51 at the time of performing the maintenance operation such as replacement of the components by a user in the embodiment will be described.

Figure 11:
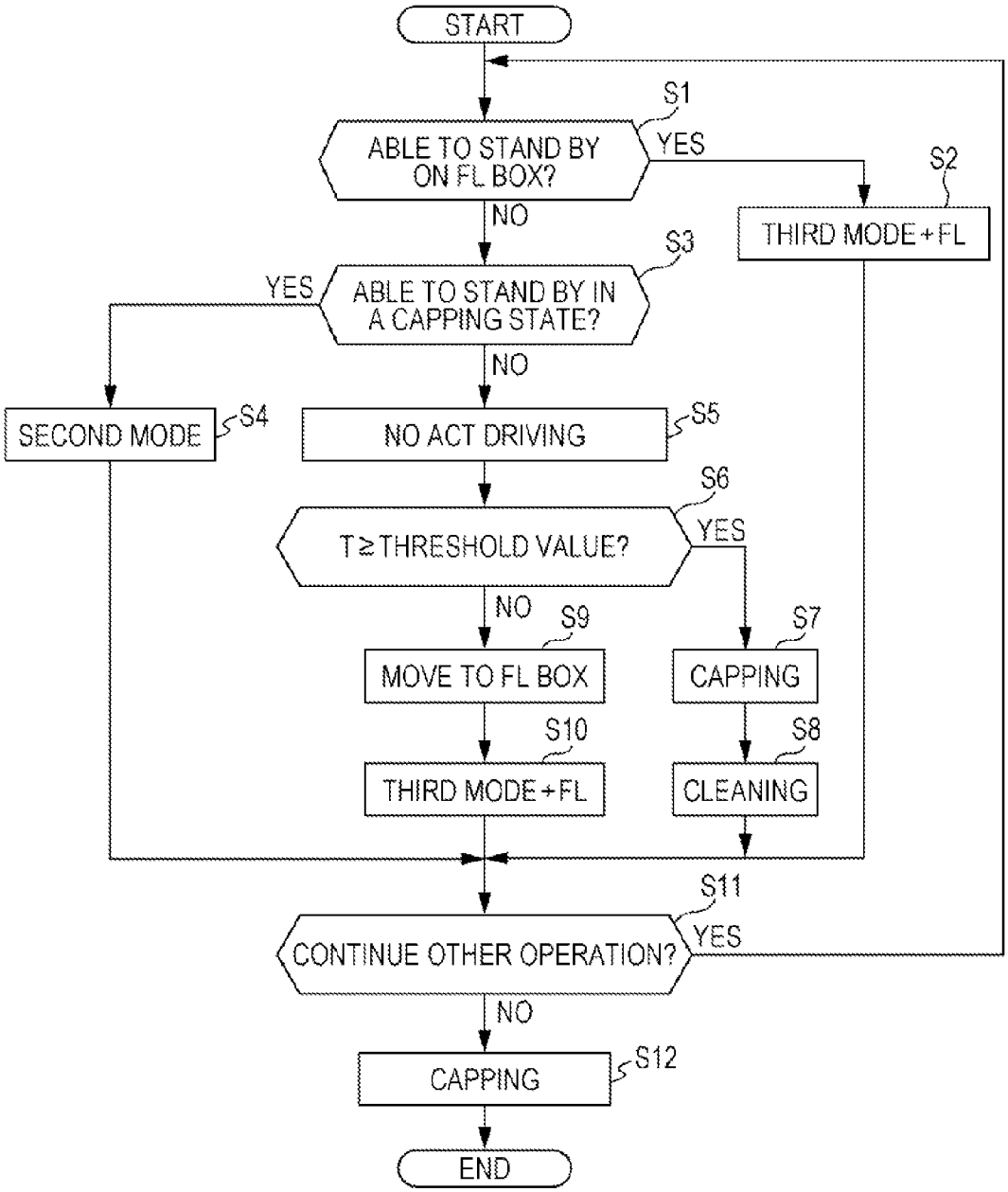
FIG. 11 is a flowchart illustrating a process of a printer at the time of maintenance operation.

FIG. 11 is a flowchart illustrating the process of the printer 51 at the time of maintenance operation. The maintenance operation includes, for example, the replacement operation of the cap 55, the wiper 59, and the flushing box 61, or the cleaning operation of the absorption cap 57. For example, the operation procedure is displayed on a liquid crystal display unit or the like provided on the main body portion of the printer 51, and a user performs the maintenance operation according to the displayed procedure.

Herein, in the printer having the configuration of the related art, in the maintenance operation, the carriage is on standby in a position not interfering with the maintenance operation, for example, on the platen (recording region with respect to the recording medium). However, since the meniscus of the nozzle of the recording head is exposed to the atmosphere in this state, the thickening of the ink readily proceeds. In addition, in a case of employing the ink having the pigment, the sedimentation of which readily occurs, there was also a problem of the sedimentation of the pigment component proceeding. With respect to this, in the printer 51 according to the invention, the standby position of the carriage 52 is differently set according to the operation content of the maintenance, and also the process of more suitably suppressing the thickening of the ink or the sedimentation of the pigment is performed according to the standby position of the carriage 52.

First, it is determined whether or not the carriage 52 can be on standby on the upper portion of the flushing box 61 (Step S1). The standby position of the carriage 52 is determined by receiving selection and designation of the content of the maintenance by a user, for example. In a case where it is determined that the carriage 52 can be on standby on the flushing box 61 (Yes), the carriage 52 is moved onto the flushing box 61 (position of A in FIG. 10), and the minute vibration operation in the third mode for a constant time and the flushing process (FL) are sequentially repeated until the predetermined operation ends. Accordingly, since the ink is agitated by the minute vibration operation in the third mode even in the maintenance operation, the sedimentation of the pigment is suppressed. In addition, if the minute vibration operation is continued, the thickening of the ink proceeds, however by performing idle-ejection of the ink by the flushing process executed at the regular interval, the thickened ink is discharged to the flushing box 61, and accordingly the viscosity of the ink is recovered to a state close to the initial value. If the predetermined operation ends, it is determined whether or not to sequentially perform an operation other than the operation described above (Step S 11). The process after Step S11 will be described later.

In a case where it is determined that the carriage cannot be on standby on the flushing box 61 in Step S1 (No), it is sequentially determined whether or not the carriage 52 can be on standby in the capped state by the capping mechanism 54 (Step S3). In a case where it is determined that the carriage can be on standby in the capped state (Yes), the carriage 52 is moved onto the capping mechanism 54 (position of B in FIG. 10), and the nozzle surface of the recording head 53 is capped by the cap 55. The minute vibration operation in the second mode is executed in the capped state, until the predetermined maintenance operation ends. In this second mode, since the intermittent interval of the minute vibration operation is longer than the case of the first mode, the sedimentation of the pigment component in the ink is decreased while suppressing the thickening of the ink. By executing the minute vibration in the second mode in the capped state as described above, since the thickening of the ink and the sedimentation of the pigment are suppressed as much as possible, it is not necessary for the flushing process or the cleaning process to be separately performed, and thus the consumption of the ink is suppressed. If the predetermined operation ends, it is determined whether or not to sequentially perform an operation other than the operation described above (Step S11).

In a case where it is determined that the carriage cannot be on standby in the capped state in Step S3 (No), that is, in a situation where the standby on both of the home position and the flushing box 61 is difficult, the carriage 52 is on standby on the upper portion of the platen 60 (position of C in FIG. 10). In this case, the flushing process cannot be performed on the platen 60. In addition, if the minute vibration is continued in this state, since the thickened ink is diffused in the pressure chamber, there is a concern of thickening of the entire ink proceeding in the recording head. Accordingly, in this case, the carriage is on standby without performing the flushing process or the minute vibration operation until the predetermined operation ends (Step S5). That is, the driving of the piezoelectric element (ACT) is not performed. Herein, the degree of thickening of the ink or the degree of the sedimentation of the pigment is different according to the time necessary for the maintenance operation. Accordingly, the operation time T is timed by a timer (not shown). A threshold value is previously set for the operation time T. It is determined whether or not the timed operation time T is equal to or greater than the threshold value at an operation end time point (Step S6).

In a case where it is determined that the operation time T is equal to or greater than the threshold value (Yes), the thickening of the ink proceeds to the degree of not being recovered from in the flushing process. Accordingly, the carriage 52 is moved to the home position, and is capped by the absorption capping mechanism 56 (Step S7). Then, the cleaning process is executed in this state (Step S8). That is, the pump is operated in the capped state to make the pressure of the inner space of the absorption cap 57 be a negative pressure, and accordingly the thickened ink is discharged from the nozzle. Thus, the viscosity of the ink in the recording head 53 is recovered to the state close to the initial state (state of being stored in the ink cartridge). This cleaning process is sequentially performed with respect to each nozzle row. If the cleaning process ends, it is determined whether or not to sequentially perform another operation (Step S11).

In a case where it is determined that the operation time T is less than the threshold value (No), the thickening of the ink is at a slight level. Accordingly, the carriage 52 is moved onto the flushing box 61, and the minute vibration operation in the third mode for a constant time and the flushing process (FL) are executed a predetermined number of times. Accordingly, in the maintenance operation, the sedimented pigment is diffused and the thickened ink is discharged from the nozzle. After that, it is determined whether or not to sequentially perform another operation (Step S11). In a case where it is determined to sequentially perform another operation (Yes), the process returns to the step S1 and the subsequent processes are executed according to the operation content. On the other hand, in a case where it is determined to end the maintenance operation without sequentially performing another operation (No), when the carriage 52 is currently on standby in a position other than the capping mechanism 54, the carriage 52 is moved onto the capping mechanism 54 and the nozzle surface of the recording head 53 is capped (Step S12). In addition, in a case where the carriage 52 is on standby in a state where the nozzle surface of the recording head 53 is capped by the capping mechanism 54, the capping state is sequentially continued. As described above, the process of the printer 51 in the maintenance operation ends.

As described above, in the embodiment, in a case where the recording head 53 mounted on the carriage 52 can be on standby on the flushing box 61 in the maintenance operation, the minute vibration operation in the third mode and the flushing process are executed in the maintenance operation, and in a case where the recording head 53 can be on standby on the capping mechanism 54, the minute vibration operation in the second mode is executed in the capped state. In addition, in a case where the recording head 53 cannot be on standby on the flushing box 61 or the capping mechanism 54, the recording head is on standby without driving the piezoelectric element and the standby time (operation time) is timed, and in a case where the timed time is equal to or greater than the threshold value, the cleaning process is executed, and on the other hand, in a case where the timed time is less than the threshold value, the minute vibration operation in the third mode and the flushing process are executed. That is, the process of suppressing the thickening of the ink or the sedimentation of the pigment or the recovering process is executed according to the standby position of the carriage 52. Therefore, the execution of the flushing process or the cleaning process is suppressed to a minimum, and the consumption of the ink can be suppressed.

The invention can also be applied to other liquid ejecting apparatuses using a liquid containing the certain component with which sedimentation occurs. For example, the invention can also be applied to a liquid ejecting apparatus which prints an image on an ink absorptive recording medium including an ink absorption layer such as paper or an ink non-absorptive recording medium not including an ink absorption layer such as plastic, a display manufacturing apparatus which manufactures a color filter such as a liquid crystal display, an electrode manufacturing apparatus which forms an electrode such as an organic Electro Luminescence (EL) display or a field emission display (FED), a chip manufacturing apparatus which manufactures a biochip, and a micropipette which accurately supplies extremely small amounts of a sample solution.

The entire disclosure of Japanese Patent Application No. 2012-274311, filed Dec. 17, 2012 is expressly incorporated by reference herein.

The entire disclosure of Japanese Patent Application No. 2013-112572, filed May 29, 2013 is expressly incorporated by reference herein.

What is claimed is:

1. A liquid ejecting apparatus comprising:

a liquid ejecting head which includes nozzles which eject liquid, a pressure chamber which communicates with the nozzles, and a pressure generation unit which generates pressure fluctuation in liquid in the pressure chamber, and which ejects liquid from the nozzles by driving of the pressure generation unit; and a driving signal generation unit which generates a minute vibration driving signal including a minute vibration waveform which is applied to the pressure generation unit to drive the pressure generation unit, and to generate pressure fluctuation in the liquid in the pressure chamber to a degree of not ejecting liquid from the nozzles, wherein the minute vibration driving signal includes a first signal section which generates a plurality of minute vibration waveforms, and a second signal section which maintains potential to a constant level, wherein the liquid ejecting apparatus has a first mode in which duration of the second signal section is set to a first time longer than duration of the first signal section, and a second mode in which the duration of the second signal section is set to a second time longer than the first time;

wherein a minute vibration operation is executed by the minute vibration driving signal in the first mode, after applying power to the liquid ejecting apparatus; and wherein a minute vibration operation is executed by the minute vibration driving signal in the second mode, after the minute vibration operation is executed in the first mode.

2. The liquid ejecting apparatus according to claim 1, wherein the minute vibration driving signal in the first mode or the minute vibration driving signal in the second mode is selected and applied with respect to the pressure generation unit corresponding to the nozzles which perform minute vibration.

3. The liquid ejecting apparatus according to claim 1, wherein a flushing process of ejecting liquid from the nozzles is executed between the minute vibration operation in the second mode and an ejecting operation of ejecting liquid with respect to a landing target from the nozzles.

4. The liquid ejecting apparatus according to claim 1, wherein a third mode which generates a minute vibration driving signal obtained only from the first signal section is set, and wherein the minute vibration operation is executed in the third mode, after execution of an ejecting operation with respect to the landing target is designated and until the ejecting operation is available.

5. The liquid ejecting apparatus according to claim 1, further comprising:

an obstacle detection unit which detects concavities and convexities or an obstacle on a liquid landing surface of a landing target, wherein the minute vibration operation in the second mode is executed after an obstacle detection operation is executed by the obstacle detection unit and until an ejecting operation of ejecting the liquid from the nozzles with respect to the landing target is available.

6. The liquid ejecting apparatus according to claim 5, wherein the minute vibration operation is executed in the second mode, after completion of the ejecting operation with respect to the landing target.

7. A controlling method of a liquid ejecting apparatus which includes a liquid ejecting head which includes nozzles which eject liquid, a pressure chamber which communicates with the nozzles, and a pressure generation unit which generates pressure fluctuation in liquid in the pressure chamber, and which ejects liquid from the nozzles by driving of the pressure generation unit, and a driving signal generation unit which generates a minute vibration driving signal including a minute vibration waveform which is applied to the pressure generation unit to drive the pressure generation unit, and to generate pressure fluctuation in the liquid in the pressure chamber to a degree of not ejecting liquid from the nozzles, wherein the minute vibration driving signal includes a first signal section which generates a plurality of minute vibration waveforms, and a second signal section which maintains potential to a constant level, and wherein the controlling method has a first mode in which duration of the second signal section is set to a first time longer than duration of the first signal section, and a second mode in which duration of the second signal section is set to a second time longer than the first time;

wherein a minute vibration operation is executed by the minute vibration driving signal in the first mode, after applying power to the liquid ejecting apparatus; and wherein a minute vibration operation is executed by the minute vibration driving signal in the second mode, after the minute vibration operation is executed in the first mode.

* * * * *